US005338231A

United States Patent [19]

Wilhite

[11] Patent Number: 5,338,231

[45] Date of Patent: Aug. 16, 1994

[54] ELECTRICAL CONNECTOR WITH CONTACT ANTI-OVERSTRESS MEANS

[75] Inventor: Mathew Wilhite, Limerick, Ireland

[73] Assignee: Molex Incorporated, Lisle, Ill.

[21] Appl. No.: 25,685

[22] Filed: Aug. 3, 1993

[30] Foreign Application Priority Data

May 8, 1992 [IE] Ireland ..... 921480

[51] Int. Cl.[5] ..... H01R 17/00

[52] U.S. Cl. ..... 439/660; 439/676; 439/862

[58] Field of Search ..... 439/660, 676, 474, 630–637, 439/862, 855, 856, 833, 839

[56] References Cited

U.S. PATENT DOCUMENTS

| | | | |
|---|---|---|---|
| 3,231,848 | 1/1966 | Ruehlemann | 439/637 |
| 3,369,214 | 2/1968 | Krumreich et al. . | |
| 4,017,143 | 4/1977 | Knowles | 439/637 |
| 4,708,415 | 11/1924 | White | 439/633 |
| 4,790,773 | 12/1988 | Hahn | 439/474 |

*Primary Examiner*—David L. Pirlot
*Attorney, Agent, or Firm*—Stephen Z. Weiss

[57] ABSTRACT

An anti-overstress system is provided in an electrical connector which includes a dielectric housing having a contact-receiving cavity with a slot communicating the cavity with a mating surface on the outside of the housing. A contact is received in the cavity and includes a cantilevered spring contact arm disposed in the slot. The arm has a contacting portion projecting beyond the mating surface of the housing for engagement with a complementary contact of the mating connector. The spring contact arm flexes in the slot upon engagement of the contacting portion by the complementary contact. The anti-overstress system is provided between the contact and the housing and includes a pair of wings projecting from opposite sides of the spring contact arm engageable with a pair of ledges formed in opposite sides of the slot after a given amount of flexing of the spring contact arm.

3 Claims, 1 Drawing Sheet

ELECTRICAL CONNECTOR WITH CONTACT ANTI-OVERSTRESS MEANS

FIELD OF THE INVENTION

This invention generally relates to the art of electrical connectors and, particularly, to an electrical connector having anti-overstress means for the contacts mounted in the connector.

BACKGROUND OF THE INVENTION

Various electrical connectors are used in environments wherein contacts or terminals are exposed exteriorly of a mating surface for mating with the contacts or terminals of a mating connector. Often, the exposed contacts are fabricated of resilient metal whereby the contacts flex into a housing of the connector upon making connection with the contacts of the mating connector. In some instances, the contacts are resiliently preloaded to increase the contact pressure capabilities thereof.

One of the problems with electrical connectors of the character described above is that the exposed contacts are prone to become overstressed if biased too far into the connector housing, thereby losing some of the contact pressure capabilities of the contacts. In some instances, the contacts may even become deformed if foreign objects, other than the contacts of the mating connector, engage the contacts and cause the contacts to become overstressed.

An example of an environment wherein electrical connectors of the character described are used, along with the stated potential problems, is in a portable telephone wherein a handset is mounted onto and off of a base module. The base module mounts an electrical connector having a plurality of contacts for making connection with surface contacts on the phone handset. The contacts are exposed exteriorly of the base module for engagement with the surface contacts on the handset. Such portable or cellular telephones are used in all kinds of applications wherein foreign objects, or even a sharp edge of the handset itself, may engage the contacts of the base module connector and drive the contacts too far into the connector, resulting in overstressing the generally fragile metal contacts.

This invention is directed to solving the above problems by providing an extremely simple anti-overstress means cooperating between the contacts and their housing.

SUMMARY OF THE INVENTION

An object, therefore, of the invention is to provide a new and improved anti-overstress means between the contacts and a housing of an electrical connector.

In the exemplary embodiment of the invention, the anti-overstress means are incorporated in an electrical connector which includes a dielectric housing having a contact-receiving cavity, with a slot communicating the cavity with a mating surface of the housing. A contact is received in the cavity with a cantilevered spring contact arm disposed in the slot and having a contacting portion projecting beyond the mating surface for engagement with a complementary contact of a mating connector. Therefore, the spring contact arm flexes in the slot upon engagement of the contacting portion by the complementary contact of the mating connector.

The invention contemplates that the anti-over-stress means be provided between the contact and the housing, and including at least one projection extending outwardly of the spring contact arm of the contact. Stop surface means are provided on the housing for abutment by the projection extending from the spring contact arm, after a given amount of flexing of the arm.

In the preferred embodiment of the invention, a pair of wings project outwardly from opposite sides of the spring contact arm. The stop surface means are provided in the form of a pair of ledges formed in opposite sides of the slot in the housing.

The contacts are stamped and formed resilient metal components. Each contact is generally U-shaped, with the spring contact arm being defined by one leg of the U-shape and the other leg defining a contact base fixed in the cavity in the housing. The contacting portion of the spring contact arm is defined by a bent crest portion intermediate the ends of the arm. The outwardly projecting wings are located between the crest portion and a juncture of the spring contact arm and the other leg of the U-shaped contact. The distal end of the spring contact arm is located under a shoulder of the housing, with the spring arm partially flexed, to preload the contact.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
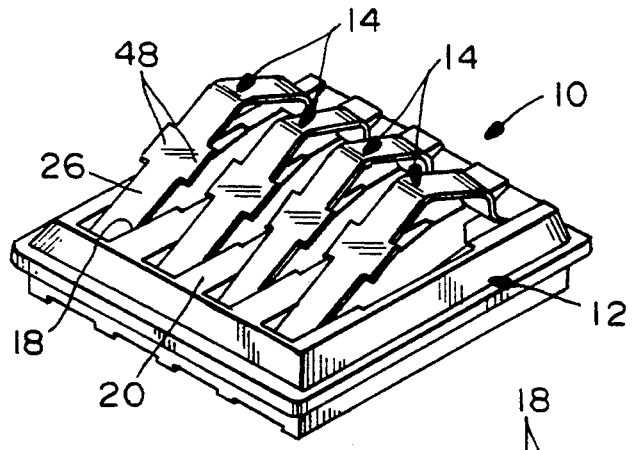
FIG. 1 is a perspective view of an electrical connector embodying the concepts of the invention.
Figure 2:
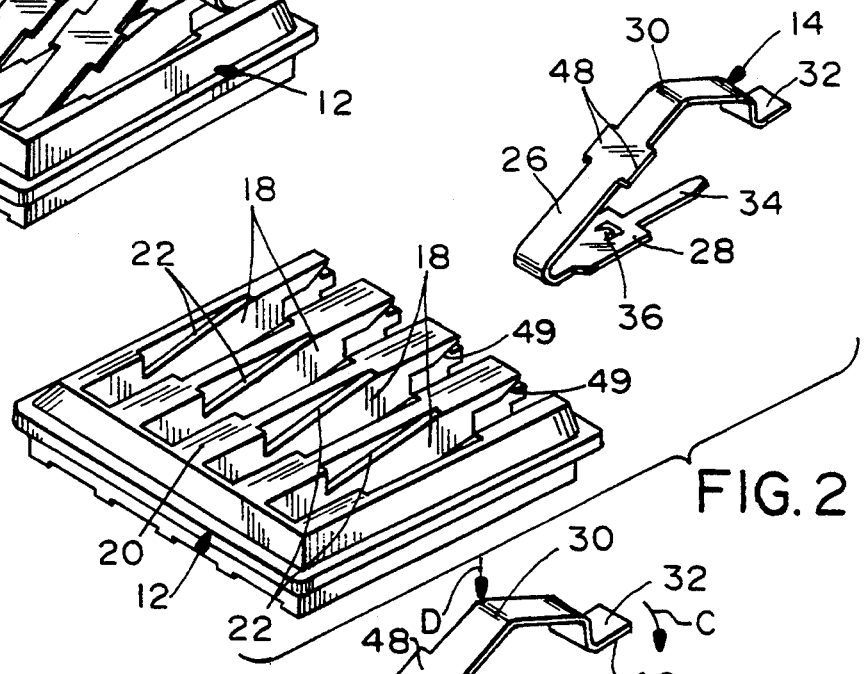
FIG. 2 is an exploded perspective view of the connector, with one of the contacts isolated from the connector housing.

Referring to the drawings in greater detail, and first to FIGS. 1 and 2, the invention is incorporated in an electrical connector, generally designated 10 (FIG. 1), which includes a dielectric housing, generally designated 12, mounting a plurality of contacts, generally designated 14. The housing is unitarily molded of plastic material or the like. Each contact is fabricated as a stamped and formed resilient metal component.

Figure 3:
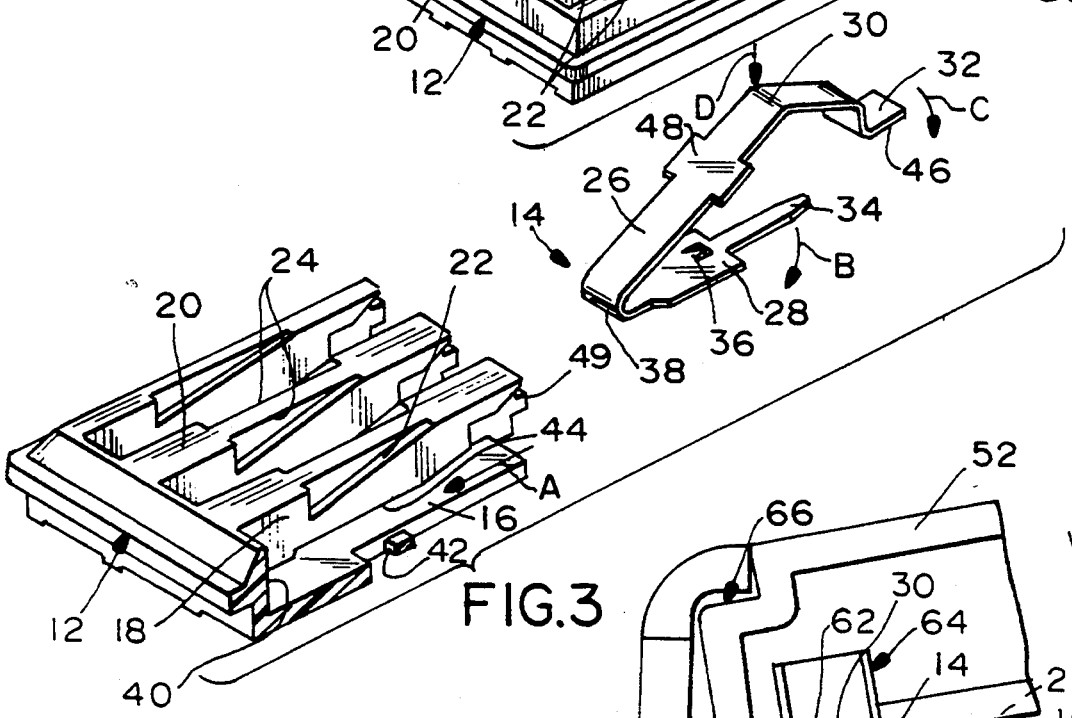
FIG. 3 is a fragmented exploded perspective view somewhat similar to that of FIG. 2, partially in section, to better illustrate one of the contact-receiving cavities in the housing.

Referring to FIG. 3 in conjunction with FIGS. 1 and 2, dielectric housing 12 includes an interior contact-receiving cavity 16 mounting each contact 14. A slot 18 communicates each cavity 16 with a mating surface 20 of the housing. Stop surface means are provided within each slot 18, by means of a pair of ledges 22 formed in opposite sides of each slot 18, as by recessed areas 24 (FIG. 3).

Each contact 14 is generally U-shaped and includes a resilient spring contact arm 26 defining one leg of the U-shape and the other leg defining a base 28 fixed within one of the cavities 16 in housing 12, as described hereinafter. A contacting portion 38 of each spring contact arm 26 is defined by a bent crest portion 30 of the arm intermediate the ends thereof. The spring contact arm terminates in a distal end 32 in order to preload the contact, as described hereinafter. Base 28 terminates in a solder tail portion 34 of the contact, which will be bent at a right-angle relative to the base, as described hereinafter. A locking tab 36 is stamped and formed out of base 28, for purposes described hereinafter.

Figure 4:
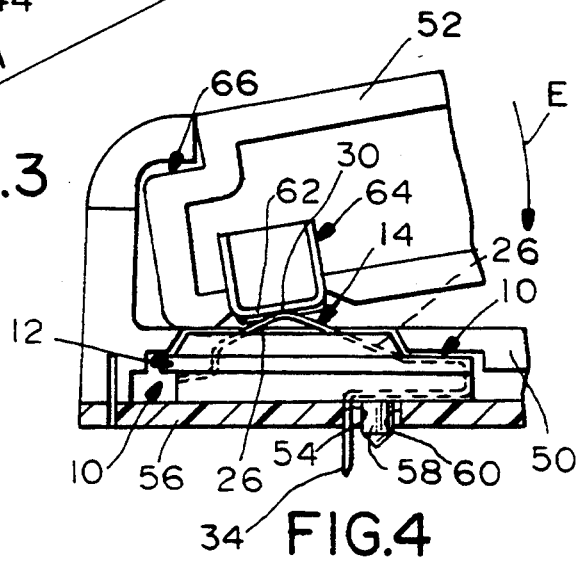
FIG. 4 is a somewhat schematic illustration of the electrical connector mounted in a base module of a portable telephone.

As best understood in relation to FIG. 3, each contact 14 is mounted in housing 12 by inserting the contact into the housing in the direction of arrow "A". Base 28 slides into cavity 16 until the juncture 38 between the legs of the U-shaped contact engage an inner wall 40 of the housing. At this point, locking tab 36 snaps into a locking aperture 42 formed in the housing at the bottom of the cavity. Therefore, the contact cannot back out of the cavity. Once fully inserted into the housing, solder tail 34 can be bent downwardly in the direction of arrow "B". The bent configuration of the solder tail is shown in FIG. 4. It can be seen in FIG. 2 that, when fully mounted in the housing, spring contact arms 26, and particularly contacting portions 30, project upwardly through slots 18 of mating surface 20 of the housing for engagement with complementary contacts of a mating connector, as described hereinafter.

It can be seen in FIGS. 2 and 3 that base 28 is wider than spring contact arm 26. The base also is wider than a respective slot 18, whereby the outwardly widened portions of the base fit under walls 44 (FIG. 3) of cavity 16 on opposite sides of the slot. In addition, means are provided for preloading spring contact arm 26. This means is provided by tabs 46 projecting transversely outwardly from distal end 32 of the spring contact arm, along with downwardly facing shoulders in the form of ramps 49 at the entrances to cavities 16. Therefore, when each contact 14 is inserted into a respective cavity 16 and slot 18 in the direction of arrow "A" (FIG. 3), tabs 46 will engage ramps 48 on opposite sides of the respective slot, biasing the spring contact arm downwardly in the direction of arrow "C" to preload the contact, with the spring arm in a partially flexed condition.

The anti-overstress means of the invention is provided by the stop surface means afforded by ledges 22 on opposite sides of slots 18, in conjunction with a pair of wings 48 projecting outwardly from opposite sides of each spring contact arm 26 intermediate its ends, particularly between contacting crest portion 30 and juncture 38 of the respective spring contact arm. Therefore, should excessive pressure be exerted on the spring contact arm in the direction of arrow "D" (FIG. 3), outwardly projecting wings 48 will engage ledges 22 on opposite sides of slots 18 to prevent the spring contact arms from being pushed downwardly into the slot beyond a given or predetermined amount of flexing of the arms which would be considered their overstressed condition.

Lastly, FIG. 4 shows one application of the invention wherein connector 10 is shown, somewhat schematically, mounted in a base module 50 of a portable telephone which includes a handset 52. It can be seen that the solder tail 34 of one of contacts 14 is bent downwardly for insertion into a hole 54 in a printed circuit board 56 for interconnection with a circuit trace on the board or in the hole. This depiction also shows that housing 12 has at least one mounting peg 58 for mounting in a complementary hole 60 in the printed circuit board. Handset 52 includes a plurality of complementary contacts 62 of a mating connector 64 for surface engaging contacts 14, particularly bent crest portions 30 of the contacts. The handset is mounted onto the base module by complementary interengaging shoulder means, as at 66, and the handset then is rotated downwardly in the direction of arrow "E" about the interengaging shoulder means, to bias spring contact arm 26 into its respective slot in housing 12. When the handset is fully "closed" onto the base module, the spring contact arm will flex completely into its respective slot and be under a proper flexed contacting condition. However, should a foreign object, or even an edge of the handset itself, accidentally be forced into engagement with the spring contact arm of one of the contacts 14, to potentially drive the spring contact arm toward an overstressed condition, wings 48 projecting outwardly from opposite sides of the contact arm will engage ledges 22 (FIG. 3) on opposite sides of the slot and prevent over-flexing and, consequently, overstressing the spring contact arm.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an electrical connector which includes a dielectric housing having a contact-receiving cavity with a slot communicating the cavity with a mating surface of the housing, and a generally U-shaped contact received in the cavity with a cantilevered spring contact arm disposed in the slot with a fixed end and a flexible end and having a contacting portion projecting beyond the mating surface for engagement with a complementary contact of a mating connector, whereby the spring contact arm flexure in the slot upon engagement of the contacting portion by the complementary contact, the improvement comprising anti-overstress means between the contact and the housing including at least one projection extending outwardly of the spring contact arms, said contact having a spring contact arm being defined by one leg of the U-shape and the other leg defining a contact based fixed in the cavity in the housing, said contacting portion being defined by a bent crest portion intermediate the ends of the arm, and stop surface means on the housing for abutment by the projection after a given amount of flexing of the spring contact arm.

2. In an electrical connector as set forth in claim 1, wherein said projection is located between the crest portion and a juncture of the spring contact arm and the other leg of the U-shaped contact.

3. In an electrical connector as set forth in claim 2, wherein the distal end of the spring contact arm is located under a shoulder of the housing, with the spring arm in a partially flexed condition, to preload the contact.

* * * * *

UNITED STATES PATENT AND TRADEMARK OFFICE

CERTIFICATE OF CORRECTION

PATENT NO : 5,338,231

DATED : August 16, 1994

INVENTOR(S) : Mathew Wilhite

It is certified that error appears in the above-identified patent and that said Letters Patent is hereby corrected as shown below:

On title page,

Item [22] should read as follows:

Filed: March 3, 1993

Signed and Sealed this

Sixteenth Day of June, 1998

Attest:

Attesting Officer

BRUCE LEHMAN

Commissioner of Patents and Trademarks